US007556167B2

(12) United States Patent
Giwargis et al.

(10) Patent No.: US 7,556,167 B2
(45) Date of Patent: Jul. 7, 2009

(54) APPARATUS AND METHOD FOR ELEVATING OBJECTS STORED IN A CONTAINER

(76) Inventors: Panipal Giwargis, 6741 N. California, Chicago, IL (US) 60645; Ninos Youkhana, 480 Edgewood La., Northfield, IL (US) 60093

( * ) Notice: Subject to any disclaimer, the term of this patent is extended or adjusted under 35 U.S.C. 154(b) by 530 days.

(21) Appl. No.: 11/210,955

(22) Filed: Aug. 24, 2005

(65) Prior Publication Data

US 2007/0051743 A1 Mar. 8, 2007

(51) Int. Cl.
*B65H 1/04* (2006.01)
*B65D 1/08* (2006.01)
*B65D 21/08* (2006.01)

(52) U.S. Cl. ..... 220/8; 220/23.83; 221/198; 221/279

(58) Field of Classification Search ..... 220/23.83, 220/8, 559; 221/198, 260, 279, 255
See application file for complete search history.

(56) References Cited

U.S. PATENT DOCUMENTS 2,110,615 A * 3/1938 Wilcox ..... 206/525
2,801,769 A * 8/1957 Theodore ..... 221/260
2,812,057 A * 11/1957 Brownfield ..... 206/250
2,849,154 A * 8/1958 Gartrell et al. ..... 221/260
2,876,930 A * 3/1959 Theodore ..... 221/260
3,439,827 A * 4/1969 Marland ..... 215/12.1
5,191,996 A * 3/1993 Jenkins ..... 221/64
5,337,915 A * 8/1994 Hall, Jr. ..... 220/495.11
5,634,569 A * 6/1997 DeCoster ..... 220/735
6,036,038 A * 3/2000 Lovelace et al. ..... 215/391
6,634,921 B1 * 10/2003 Coulthard, Jr. ..... 446/221
6,745,918 B2 * 6/2004 Greene ..... 221/198

* cited by examiner

*Primary Examiner*—Anthony D Stashick
*Assistant Examiner*—Niki M Eloshway
(74) *Attorney, Agent, or Firm*—Howard B. Rockman

(57) ABSTRACT

An apparatus for selectively elevating objects stored in a container, the apparatus comprising a lift that includes a base, at least one guide having a first end coupled to the base, and an outer ring, wherein the at least one guide includes a second end coupled to the outer ring, whereby the outer ring may be vertically adjusted along a container sidewall surface resulting in vertical adjustment of the base within the container interior.

5 Claims, 2 Drawing Sheets

APPARATUS AND METHOD FOR ELEVATING OBJECTS STORED IN A CONTAINER

BACKGROUND

1. Field of the Invention

The invention relates to a device for selectively elevating objects stored in containers. More particularly, the invention relates to a device for elevating stacked objects, such as food products, stored in upright containers.

2. Upright containers of various sizes and configurations are used to stored objects. For example in the food industry, cylindrical and rectangular containers are often used to stored stacked foodstuffs such as, but not limited to, potato chips, cookies, and crackers. Prior art devices include elevating dispensers that use (1) a sling (U.S. Pat. No. 6,745,918) or (2) a vertically adjustable flexible bag (U.S. Pat. No. 5,337,915) as the lifting device. What is needed is a simple lifting device that supports and suspends objects stored in containers.

SUMMARY OF THE INVENTION

This invention relates to an apparatus for selectively elevating objects stored in containers, the apparatus comprising: a container that includes a bottom wall, and at least one sidewall extending from the bottom wall, the sidewall having an outer surface, an inner surface extending around an open interior of the container, an outer surface, and a top edge extending around an opening of the container, the opening providing access to the container interior; and a lift, comprising a base positioned in the container interior; at least one guide having a first end coupled to the base; and an outer ring positioned adjacent the container sidewall outer surface, wherein the at least one guide includes a second end coupled to the outer ring, whereby the outer ring may be vertically adjusted along the container sidewall outer surface resulting in vertical adjustment of the base within the container interior.

BRIEF DESCRIPTION OF THE DRAWINGS

Further objects and features of the present invention are revealed in the following detailed description of the preferred embodiments of the invention and the drawing figures wherein.

DETAILED DESCRIPTION

A detailed description of the present invention is described herein with reference to the accompanying drawing figures. Terms of reference such as "top," "bottom," or "side" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

Figure 2:
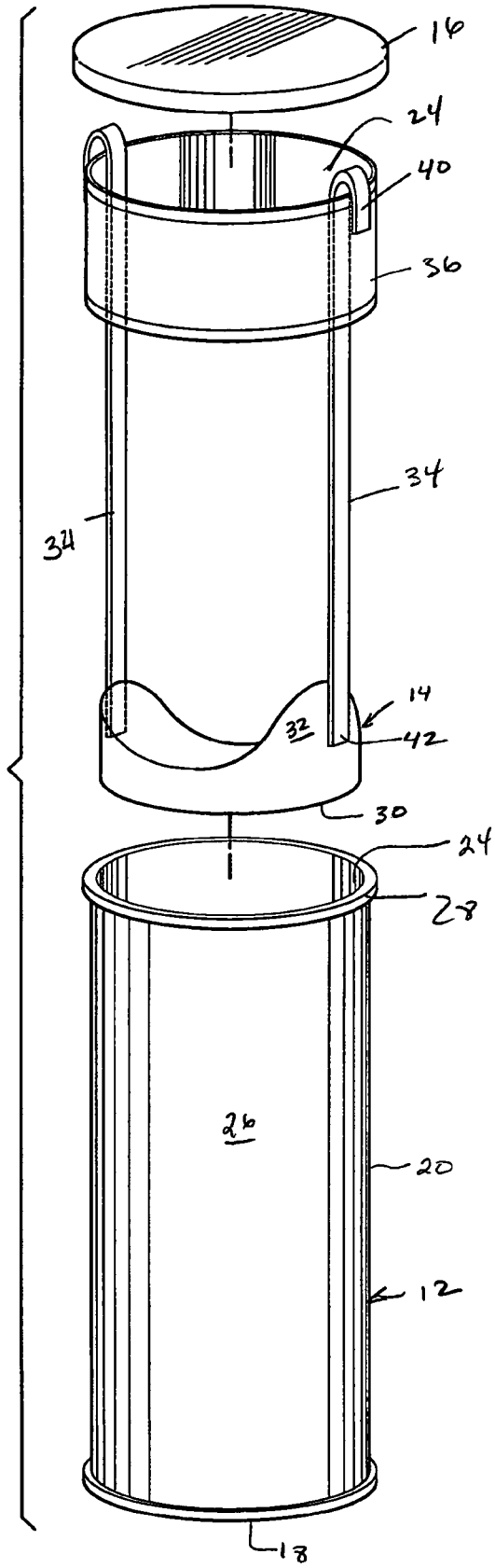
FIG. 2 shows an assembly view of the apparatus shown in FIG. 1.

In the most general form, the invention relates to an apparatus for selectively elevating or lifting objects stored in an upright container. The accompanying drawings show an illustrative embodiment an apparatus 10 formed in accordance with the teachings of the present invention. As best seen in FIG. 2, the apparatus 10 includes a container 12, a lift 14 and a sealing cover member 16 releasably securable over a top opening of the container 12.

In the illustrative embodiment, the container 12 is comprised of a substantially round or circular bottom wall 18 and a sidewall 20. The sidewall 20 extends upwards from the bottom wall 18, forming an open top cylindrical container. More particularly, as best seen in FIG. 2, the container 12 may include a bottom wall 18 and at least one sidewall 20 extending from the bottom wall 18, the sidewall 20 having an inner surface 24 extending around an open interior 24 of the container 12 and the sidewall 20 having an outer surface 26 that forms the exterior of the container 12. The sidewall 20 also includes a top edge 28 extending around the opening interior 24 of the container 12. The open interior 24 provides access to the interior of the container 12.

In other applications of the invention it may be desirable to form the container with the sidewalls and bottom wall having a configuration other than that shown. For example, if the assembly 10 is used to store crackers, slices of bread or magazines, the container of the apparatus would have the general configuration of a rectangle or square.

The container 12 may be constructed of fiberboard, for example, but not limited to, cardboard. However, other types of materials, such as for example, molded plastic, or other methods of construction may be employed in constructing the apparatus of the invention.

The cover member 16 of the apparatus 10 may be configured to engage in a snap fit, sealed engagement over the top edge 28 of the container 12 and completely enclose the container interior 24, as best seen in FIG. 2. The cover member 16 may be molded from plastic. However, the cover member 16 may be constructed from other materials and by other methods.

Figure 1:
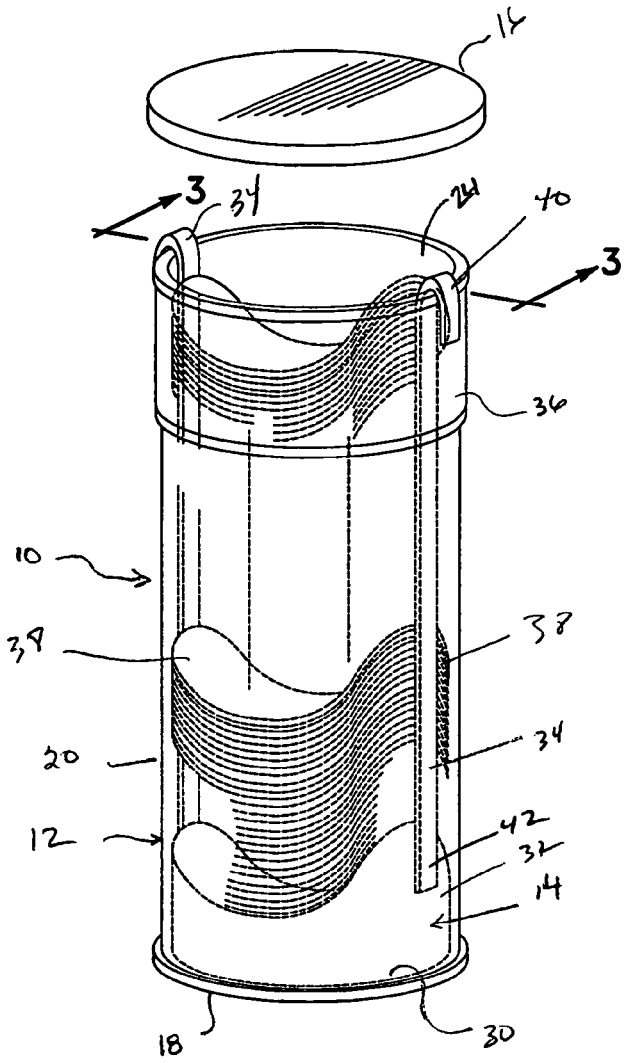
FIG. 1 illustrates an apparatus for selectively elevating objects stored in a container formed in accordance with the teachings of the present invention.
Figure 3:
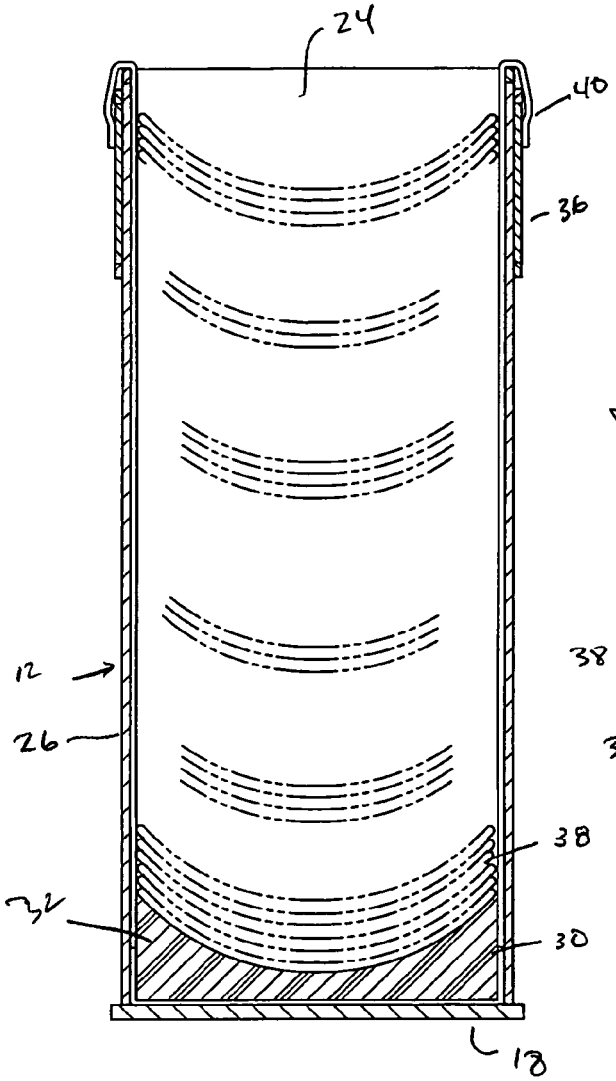
FIG. 3 is section view taken along the line 3-3 shown in FIG. 1, showing the position of the apparatus.
Figure 4:
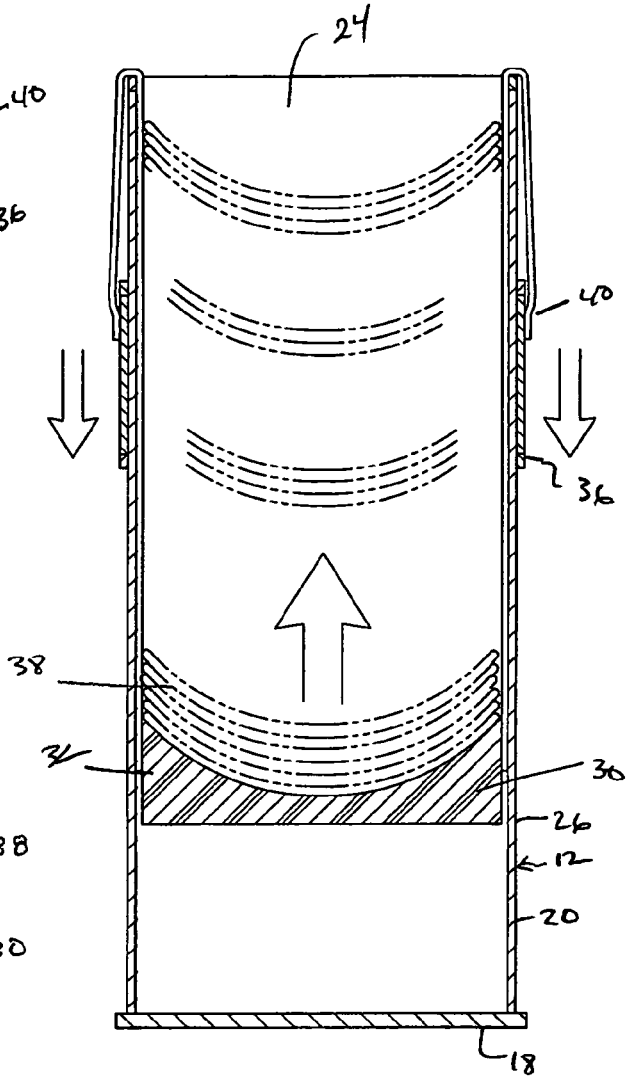
FIG. 4 illustrates one method of suspending a portion of the apparatus during use.

As best seen in FIGS. 1 and 2, the lift 14 may include a base 30, one or more guides 34 and an outer ring 36. The base 30 is used to elevate or lift the objects stored in the container 12, as best seen in FIGS. 1 and 3-4. The base 30 may be configured having a form and size that permit it to be placed in the interior of the container with which it is to be used. In the embodiment shown, the base 30 has a circular cross-section. The base 30 may also be constructed to include a sidewall 32. As best seen in FIG. 2, the sidewall 32 may extend around at least a portion of the base 30.

As shown in FIGS. 1 and 2, the lift 14 includes at least one guide 34. Although the illustrative embodiment shows two guides 34, it will be appreciated by one of ordinary skill in the art 30 that the lift could be constructed using any number of guides. The guide 34 is an elongated member. As best seen in FIG. 2, the guide includes a first end supported by the base and a second end supported by the outer ring 36 (discussed below). The guide 34 should include a length that permits adjustment of the base 30 at any point between the top edge 28 and the bottom 18 of the container 12.

The lift 14 also includes an outer ring 36. In the illustrated embodiment, the outer ring 36 is configured having a circular shape. It will be appreciated, however, that the outer ring 36 may be constructed in a configuration and size that permit it to traverse surface of the container with which it will be used. For example, in the illustrated embodiment, when incorporated in the assembly 10, the outer ring 36 extends around at least a portion of the exterior sidewall surface 26, as best seen in FIG. 1. Hence, a circular configuration of the outer ring 36 was chosen.

As best seen in FIGS. 1 and 2, a portion of the outer ring 36 supports a portion of the guides 34 such that the outer ring 36 may be vertically adjusted along the exterior sidewall surface 26, resulting in vertical adjustment of the base 30 within the container 12 interior.

The outer ring 36 and the base 30 may be constructed of fiberboard, for example cardboard or other suitable materials that will permit frictional engagement between the outer ring 36 and the exterior sidewall surface 26. The outer ring may also be configured to carry graphic information, such as but not limited to, coupons or games of chance.

The guides 34 may be constructed of a flexible material having suitable strength and flexibility to support the base 30 and the contents of the container 12 and to travel along the inner and outer surfaces of the container 12 as the outer ring 36 is vertically adjusted along the exterior sidewall surface 26.

As best seen in FIG. 1, the apparatus 10 is formed by placing a porting of the lift 14 in the interior of the container 12 and by placing a portion of the lift 14 adjacent the exterior of the container 12. As shown in FIG. 1, the base 34 may be placed in the container's open center 24, and the outer ring 36 may be positioned adjacent the outer exterior surface 26 of the container 12. This arrangement causes the guides 34 to extend along the height of the container, and permits selective positioning of the base 30 within the open center 24 by vertically adjusting the position of the outer ring 36 along the outer exterior surface 26 of the container 12. When the lift 14 is being used to lift or suspend objects, the inner surface of the outer ring 36 may frictionally engage the exterior sidewall surface 26 to suspend the outer ring 36 in position along the exterior sidewall surface 26, resulting in the base 30 being suspended in the container interior.

In other embodiments, the outer ring 36 may engage in sliding friction engagement with the exterior sidewall surface 26 to suspend the base 30 in an adjustable position above the container bottom 18, enabling adjusting a suspended position of the base 30 above the container bottom 18 in a first direction away from the container bottom 18 in response to sliding the outer ring 36 along the exterior sidewall surface 26 in a second direction opposite to the first direction.

Regardless of the embodiment used, the friction engagement between the outer ring 36 and the exterior sidewall surface 26 should be sufficient to suspend the base 30 and the food products 38 supported by the base 30 in the container interior 24 in a variety of vertically adjusted positions above the container bottom 18.

More particularly, vertically adjusting the outer ring 36 along the exterior surface sidewall 26 permits selective positioning of the base 30 and food product 38 in a vertically adjusted position relative to the container bottom 18. For example, by sliding the outer ring 36 in a downward direction along the exterior sidewall surface 26, the base 30 and the food product 38 will rise in the container 12 interior relative to the container bottom 18 and the food products contained in the container 12 will be moved toward the above the top edge 28 of the container 12 as shown in FIGS. 3 and 4. In this manner, the food products 38 supported by the base 30 may be raised to the top of the container 12 and dispensed from the container top opening, or may be lowered down into the container interior below the container top opening.

In one embodiment, a method for elevating stacked items using a lift 14 as taught herein may include (1) providing a container having a bottom wall and at least one sidewall supported by the bottom wall, the sidewall having an inner surface extending around an open interior of the container, an outer surface, and a top edge extending around an opening of the container, the opening providing access to the container interior; (2) providing a lift assembly including a base positioned in the container interior; at least one guide having a first end coupled to the base; and an outer ring positioned adjacent the container sidewall outer surface, wherein the at least one guide includes a second end coupled to the outer ring; (3) adjusting vertically the outer ring along the container sidewall outer surface, wherein the inner surface of the outer ring engages in friction engagement with the container sidewall outer surface to suspend the outer ring in position along the container sidewall outer surface; and (4) suspending the base in the container interior by the friction engagement of the inner surface of the outer ring and the container sidewall outer surface.

While the present invention has been described by reference to a specific embodiment, it should be understood that modifications and variations of the invention may be constructed without departing from the scope of the invention defined in the following claims. For example, the apparatus of the invention may be employed in lifting and suspending objects other than food products. In the Detailed Description, the invention is illustrated using food products, specifically, stacked potato chips. However, this illustration of the invention should not be interpreted as limiting, as one of ordinary skill in the art would realize that certain modifications would come within the teachings of this invention without departing from the spirit and scope of the appended claims. Therefore, the following claims should be studied to determine the true scope and content of the invention.

What is claimed is:

1. An apparatus for selectively elevating stacked objects stored in a container, the apparatus comprising:

a container comprising:

a bottom wall, and at least one sidewall extending from the bottom wall, the sidewall having an outer surface, an inner surface extending around an open interior of the container, and a top edge extending around an opening of the container, the opening providing access to the container interior;

a lift, comprising:

a solid inflexible base positioned in the container interior, said solid inflexible base adapted to provide a rigid platform supporting said stacked objects stored in said container;

at least one flexible guide having a first end coupled to the base;

an outer ring positioned adjacent the container sidewall outer surface, wherein the at least one guide includes a second end coupled to the outer ring, whereby the outer ring is vertically adjustable along the container sidewall outer surface resulting in vertical adjustment of the base within the container interior; and an inner surface of the outer ring is in friction engagement with the container sidewall outer surface to suspend the outer ring at a first position along the container sidewall outer surface, the solid inflexible base being suspended in the container interior at a second position by the friction engagement of the inner surface of the outer ring and the container sidewall outer surface.

2. The apparatus defined in claim 1, wherein the base further includes a sidewall portion.

3. The apparatus of claim 1, wherein the outer ring engages in friction engagement with the container sidewall outer surface to adjustably suspend the base in said second position above the container bottom wall in the container interior, enabling adjusting a suspended position of the base above the container bottom wall in a first direction away from the container bottom wall in response to adjusting the outer ring along the container sidewall outer surface in a second direction, opposite to the first direction.

4. An apparatus for selectively elevating stacked solid food products stored in a container, the apparatus comprising:

a container having a bottom wall and at least one sidewall connected to the bottom wall and extending from the bottom wall, the sidewall having an inner surface extending around an open interior of the container and the sidewall having an outer surface extending around an exterior of the container, and the sidewall having a top edge extending around an opening of the container, the opening providing access to the container interior;

a lift, comprising:

a solid inflexible base having a sidewall p onion, wherein said solid inflexible base is positioned in the container interior, said solid inflexible base adapted to provide a rigid platform for supporting said stacked solid objects stored in said container;

two flexible guides, each having a first end coupled to opposite sides of the sidewall portion of the base; and an outer ring positioned adjacent the container sidewall outer surface, wherein the two guides include a second end coupled to opposite sides of the outer ring, the outer ring being vertically adjustable along the container sidewall outer surface resulting in vertical adjustment of the base within the container interior; and an inner surface of the outer ring engaging in friction engagement with the container sidewall outer surface to suspend the outer ring in a first position along the container sidewall outer surface, the solid inflexible base being suspended in the container interior in a second position by the friction engagement of the inner surface of the outer ring and the container sidewall outer surface.

5. The apparatus of claim 4, wherein the outer ring engages in friction engagement with the container sidewall outer surface to adjustably _suspend the base in said second position above the container bottom wall in the container interior, enabling adjusting a suspended position of the base above the container bottom wall in a first direction away from the container bottom wall in response to adjusting the outer ring along the container sidewall outer surface in a second direction opposite to the first direction.

* * * * *